US007178611B2

(12) United States Patent
Zupanick

(10) Patent No.: US 7,178,611 B2
(45) Date of Patent: Feb. 20, 2007

(54) SYSTEM AND METHOD FOR DIRECTIONAL DRILLING UTILIZING CLUTCH ASSEMBLY

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 261 days.

(21) Appl. No.: 10/811,118

(22) Filed: Mar. 25, 2004

(65) Prior Publication Data

US 2005/0211473 A1 Sep. 29, 2005

(51) Int. Cl.
*E21B 7/04* (2006.01)

(52) U.S. Cl. ..... 175/75; 175/107

(58) Field of Classification Search ..... None
See application file for complete search history.

(56) References Cited

U.S. PATENT DOCUMENTS

| | | | |
|---|---|---|---|
| 1,660,033 | A | 2/1928 | Braswell |
| 2,624,549 | A | 1/1953 | Wallace |
| 3,085,639 | A | 4/1963 | Fitch |
| 3,194,331 | A | 7/1965 | Arnold |
| 3,360,960 | A | 1/1968 | Massey |
| 3,552,492 | A | 1/1971 | Mullins |
| 3,553,980 | A | 1/1971 | Dickinson et al. |
| 3,912,023 | A | 10/1975 | Amtsberg |
| 3,971,450 | A | 7/1976 | Fox |
| 4,043,410 | A | 8/1977 | Bennett et al. |
| 4,049,066 | A | 9/1977 | Richey |
| 4,058,192 | A | 11/1977 | Haigh |
| 4,061,197 | A | 12/1977 | Skidmore, Jr. |
| 4,295,535 | A | 10/1981 | Crase et al. |
| 4,365,678 | A | 12/1982 | Fitch |
| 4,460,202 | A | 7/1984 | Chance et al. |
| 4,465,146 | A | 8/1984 | Fitch |
| 4,467,879 | A | 8/1984 | Burge |

(Continued)

FOREIGN PATENT DOCUMENTS

| | | | |
|---|---|---|---|
| GB | 2 381 806 | A | 5/2003 |

(Continued)

OTHER PUBLICATIONS

Notification of Transmittal of the International Search Report and the Written Opinion of the Internationl Searching Authority, or the Declaration (3 pages), International Search Report (4 pages), and Written Opinion of the International Searching Authority (5 pages) for International Application No. PCT/US2005/008774 mailed Jun. 10, 2005.

(Continued)

*Primary Examiner*—Frank S. Tsay
(74) *Attorney, Agent, or Firm*—Fish & Richardson P.C.

(57) ABSTRACT

According to one embodiment of the invention, a system for directional drilling within a wellbore includes a drill string having an upper portion, a lower portion, a bent motor coupled to the lower portion, and a drill bit coupled to bent motor, and a clutch assembly disposed between the upper and lower portions. The clutch assembly is operable to disengage the upper and lower portions of the drill string and allow the upper portion to rotate while the lower portion does not rotate.

27 Claims, 6 Drawing Sheets

U.S. PATENT DOCUMENTS 4,484,642 A 11/1984 Evans
4,489,793 A 12/1984 Boren
4,540,055 A 9/1985 Drummond et al.
4,811,800 A 3/1989 Hill et al.
4,813,497 A 3/1989 Wenzel
4,819,745 A 4/1989 Walter
4,830,122 A 5/1989 Walter
4,848,490 A 7/1989 Anderson
4,912,415 A 3/1990 Sorensen
4,958,692 A 9/1990 Anderson
4,979,577 A 12/1990 Walter
5,009,272 A 4/1991 Walter
5,040,620 A 8/1991 Nunley
5,040,622 A 8/1991 Winship et al.
5,042,600 A 8/1991 Finnegan et al.
5,050,692 A 9/1991 Beimgraben
5,127,482 A 7/1992 Rector, Jr.
5,137,087 A 8/1992 Szarka et al.
5,165,491 A * 11/1992 Wilson ..... 175/62
5,190,114 A 3/1993 Walter
5,322,136 A 6/1994 Bui et al.
5,377,761 A 1/1995 Kosar et al.
5,484,029 A 1/1996 Eddison
5,522,467 A 6/1996 Stevens et al.
5,526,888 A 6/1996 Gazewood
5,649,603 A * 7/1997 Simpson et al. ..... 175/323
5,673,764 A 10/1997 Falgout, Sr.
5,730,221 A * 3/1998 Longbottom et al. ..... 166/298
5,775,444 A 7/1998 Falgout, Sr.
5,782,310 A 7/1998 Lange
5,787,981 A 8/1998 Taylor
5,862,862 A * 1/1999 Terrell ..... 166/298
6,082,457 A 7/2000 Best et al.
6,241,032 B1 6/2001 Falgout, Sr.
6,279,670 B1 8/2001 Eddison et al.
6,289,596 B1 9/2001 Anderson et al.
6,321,857 B1 11/2001 Eddison
6,431,294 B1 8/2002 Eddison et al.
6,439,318 B1 8/2002 Eddison et al.
6,439,321 B1 * 8/2002 Gillis et al. ..... 175/73
6,453,999 B1 * 9/2002 Reinholdt ..... 166/241.3
6,508,317 B2 1/2003 Eddison et al.
6,588,518 B2 7/2003 Eddison
6,615,933 B1 9/2003 Eddison
2001/0052428 A1 12/2001 Larronde et al.
2002/0050359 A1 5/2002 Eddison
2003/0127857 A1 7/2003 Boyd et al.

FOREIGN PATENT DOCUMENTS

WO WO98/38410 9/1998

OTHER PUBLICATIONS

Maidla, E., et al., "Understanding Torque: The Key to Slide-Drilling Directional Wells," IADC/SPE 87162, Society of Petroleum Engineers, 7 pages, Mar. 2-4, 2004.

Notification Concerning Transmittal of Copy of Internatinal Preliminary Report on Patentability (1 page), International Preliminary Report on Patentability (1 page), and Written Opinion of the International Searching Authority (5 pages) for International Application No. PCT/US2005/008774 mailed Oct. 5, 2006.

* cited by examiner

SYSTEM AND METHOD FOR DIRECTIONAL DRILLING UTILIZING CLUTCH ASSEMBLY

TECHNICAL FIELD OF THE INVENTION

This invention relates generally to the field of drilling systems and, more particularly, to a system and method for directional drilling utilizing a clutch assembly.

BACKGROUND OF THE INVENTION

Drilling wellbores in the earth, such as wellbores used for the production of oil and gas, is a well established art. One type of drilling system is rotary drilling, which uses a drill bit at the end of a drill string to drill into the earth. At the surface, a drilling rig controls the position and rotation of the drill string below the surface. Underneath the surface, the drill bit is attached to the drill string that transports drilling fluid to the drill bit. The drilling fluid lubricates and cools the drill bit and also functions to remove cuttings and debris from the wellbore as it is being drilled.

While simple rotary drilling has been employed for many years, directional drilling is becoming a more common drilling practice. Directional drilling involves changing the direction of drilling as needed to reach a desired wellbore endpoint, or to create a desired wellbore pattern. For example, a whipstock may be inserted into the wellbore and used to deflect the drill bit in the desired direction. Another type of directional drilling involves the use of bent motors in which a slight curvature of the bent motor allows steering of the direction of the wellbore. To steer using a bent motor, rotation of the drill string is halted while allowing the drill bit to continue to rotate. Because the bent motor is slightly angled and because the drill string is not rotating, the drill string is effectively steered in the direction of the bend of the motor as the drill bit continues to move forward. This "directional drilling" may be difficult due to static friction between the non-rotating drill string and wall of the wellbore, especially for long drill strings.

Prior techniques for overcoming this static friction condition include "rocking" or "winding up" the drill string. This process utilizes the torsional flexibility of the drill pipe to allow short, cyclical reversing of the direction of rotation of the drill pipe. In this process, the drill pipe is quickly rotated back-and-forth at the surface, yet borehole friction prevents the torque from being transmitted to, or changing the orientation of the bent motor assembly. Vibrating the pipe with either a surface or down-hole vibrating device may also be employed to overcome static friction. Additionally, rotary steerable systems may be used, in which the entire drill string continues to rotate while adjustable near-bit stabilizers force the drill pipe to become eccentric within the wellbore, thus causing wellbore deviation to take place.

SUMMARY OF THE INVENTION

According to one embodiment of the invention, a system for directional drilling within a wellbore includes a drill string having an upper portion, a lower portion, a bent motor coupled to the lower portion, and a drill bit coupled to bent motor, and a clutch assembly disposed between the upper and lower portions. The clutch assembly is operable to rotationally disengage the upper and lower portions of the drill string and allow the upper portion to rotate while the lower portion does not rotate.

According to another embodiment of the invention, a system for directional drilling within a wellbore includes a drill string having an upper portion, a lower portion, a bent motor coupled to the lower portion, and a drill bit coupled to bent motor, and a ratchet assembly disposed between the upper and lower portions. The ratchet assembly is operable to rotationally disengage the upper and lower portions of the drill string during rotation in only one direction and allow the upper portion to rotate while the lower portion does not rotate.

Embodiments of the invention may provide numerous technical advantages. Some embodiments may benefit from some, none, or all of these advantages. For example, according to certain embodiments, a clutch assembly associated with the drill string allows rotation of a majority of the drill sting while preventing rotation of the portion of the drill string that contains the drill motor and bit. This substantially reduces or eliminates any static friction between the majority of the rotated drill string and wall of the wellbore, thereby allowing directional drilling with a bent motor to be performed in an efficient manner. That portion of the drill string between the clutch assembly and the drill motor and bit includes enough weight to resist the reactive torque of drill motor, thereby providing stability for maintaining orientation of the bent motor assembly. This lower section slides along the path of the wellbore while the rotating upper section, free from static friction, effectively transfers the necessary force to advance the sliding section ahead. In particular embodiments, the clutch assembly may be actuated by altering the fluid flow down the drill string.

Other technical advantages are readily apparent to one skilled in the art.

DETAILED DESCRIPTION

Figure 1:
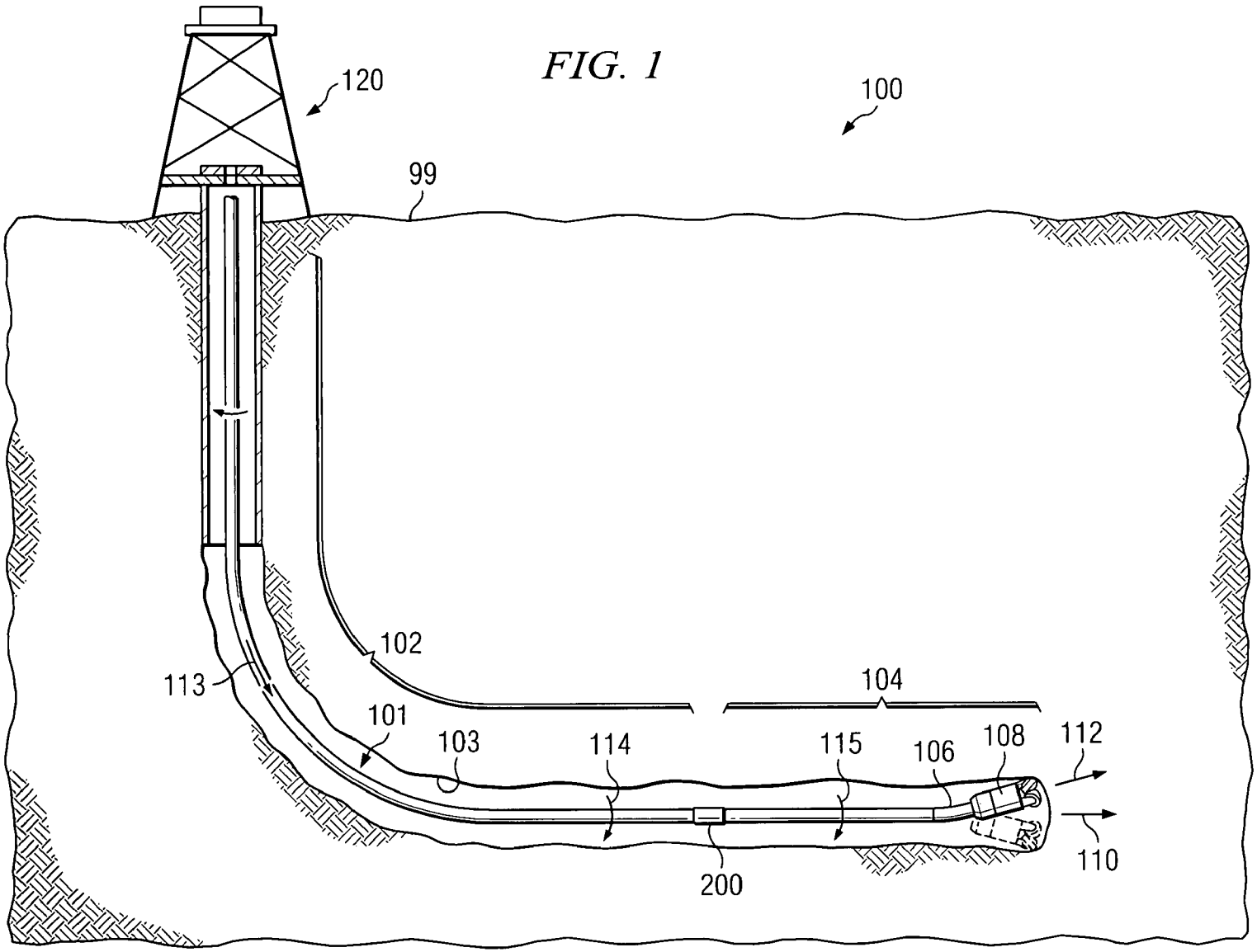
FIG. 1 is a schematic diagram of a system for directional drilling within a wellbore in accordance with one embodiment of the present invention.

FIG. 1 is a schematic diagram of a system 100 for directional drilling within a wellbore 103 in accordance with one embodiment of the present invention. In the illustrated embodiment, system 100 is being utilized for directional drilling to alter the direction of wellbore 103 from a first direction 110 to a second direction 112. Both first direction 110 and second direction 112 may be any suitable direction below a ground surface 99. System 100 may be used to drill a wellbore having any type of change in direction, including without limitation, an articulated wellbore or any type of wellbore (including an articulated or slanted wellbore) from which one or more lateral wellbores are drilled.

In the illustrated embodiment, system 100 includes a drill string 101 having an upper portion 102, a lower portion 104, a bent motor 106, a drill bit 108, and a clutch assembly 200 disposed between upper portion 102 and lower portion 104.

According to the teachings of particular embodiments of the invention, clutch assembly 200 functions to disengage upper portion 102 and lower portion 104 to allow upper portion 102 to rotate while lower portion 104 does not rotate. This facilitates drilling wellbore 103 in second direction 112 more efficiently because the rotation of upper portion 102 while drill bit 108 is directed in second direction 112 (via bent motor 106) helps to overcome static frictional forces associated with the engagement of drill string 101 with the wall of wellbore 103. Among other advantages, this avoids having to use vibrating devices or rotary steerable systems. The practice of cyclically "rocking" or "winding up" the drill string to help overcome this friction also becomes unnecessary. Various embodiments of clutch assembly 200 are described below in conjunction with FIGS. 2A through 4B.

Upper portion 102 and lower portion 104 of drill string 101 may each have any suitable length and any suitable number of drill pipe sections; however, in particular embodiments, lower portion 104 has a sufficient length and weight to resist the reactive torque of drill bit 108 while drilling. In one example embodiment, the reactive torque of drill bit 108 is counteracted by having lower portion 104 with a weight of at least 10,000 pounds and/or a length of 1000 feet. Any suitable drill bit may be utilized for drill bit 108 and it may be driven in any suitable manner, such as a downhole progressive cavity motor. Bent motor 106 may be any suitable device that rotates and provides a slight angle to the drill bit 108 with respect to drill string 101 to facilitate directional drilling when lower section 104 is not rotating.

In operation of one embodiment of the invention, to drill in first direction 110, a suitable drilling fluid is pumped down through drill string 101 in the direction of arrow 113 while both upper portion 102 and lower portion 104 of drill string 101 are rotated in a first rotational direction, as indicated by arrows 114, 115. A drilling rig 120 or other suitable drilling system may be utilized to rotate drill string 101 and pump drilling fluid down through drill string 101. Drill bit 108 is also rotated using a mud motor or other suitable device. In order to have both upper portion 102 and lower portion 104 rotating at the same time, clutch assembly 200 is engaged. The bent motor assembly is continuously rotated and the drilling direction is primarily straight ahead.

When it is desired to start drilling wellbore 103 in second direction 112, the rotation of at least lower portion 104 is stopped so that drill bit 108 may start drilling in second direction 112. More specifically, the rotation of bent motor 106, which is bent at a slight angle with respect to drill string 101, is stopped such that the forward motion of drill bit 108 causes drill bit 108 to drill in the direction of bent motor 106. In order to prevent lower portion 104 and bent motor 106 from rotating, clutch assembly 200 disengages upper portion 102 from lower portion 104 so that lower portion 104 stops rotating. However, upper portion 102 keeps rotating in order to help overcome the static friction between upper portion 102 of drill string 101 and the wall of wellbore 103. This facilitates more efficient drilling in second direction 112 by allowing more weight to be transferred to the bit.

Depending on the configuration of clutch assembly 200, clutch assembly 200 may be disengaged by increasing the flow rate of fluid down through drill string 101, as illustrated in FIGS. 2A and 2B or 3A and 3B. For example, an initial flow rate may be approximately one hundred fifty gallons per minute when clutch assembly 200 is engaged, while a flow rate of approximately two hundred gallons per minute may disengage clutch assembly 200. Other suitable methods may be utilized to engage and disengage clutch assembly 200, such as an electro-magnetic system, which sends a signal to clutch assembly 200. In another embodiment of the invention, in order to disengage clutch assembly 200, drill string 101 is rotated in a second rotational direction opposite that of first rotational direction 114. In this embodiment, the clutch assembly 200 resembles a ratcheting assembly, such as the one shown and described below in conjunction with FIGS. 4A and 4B.

Figure 2A:
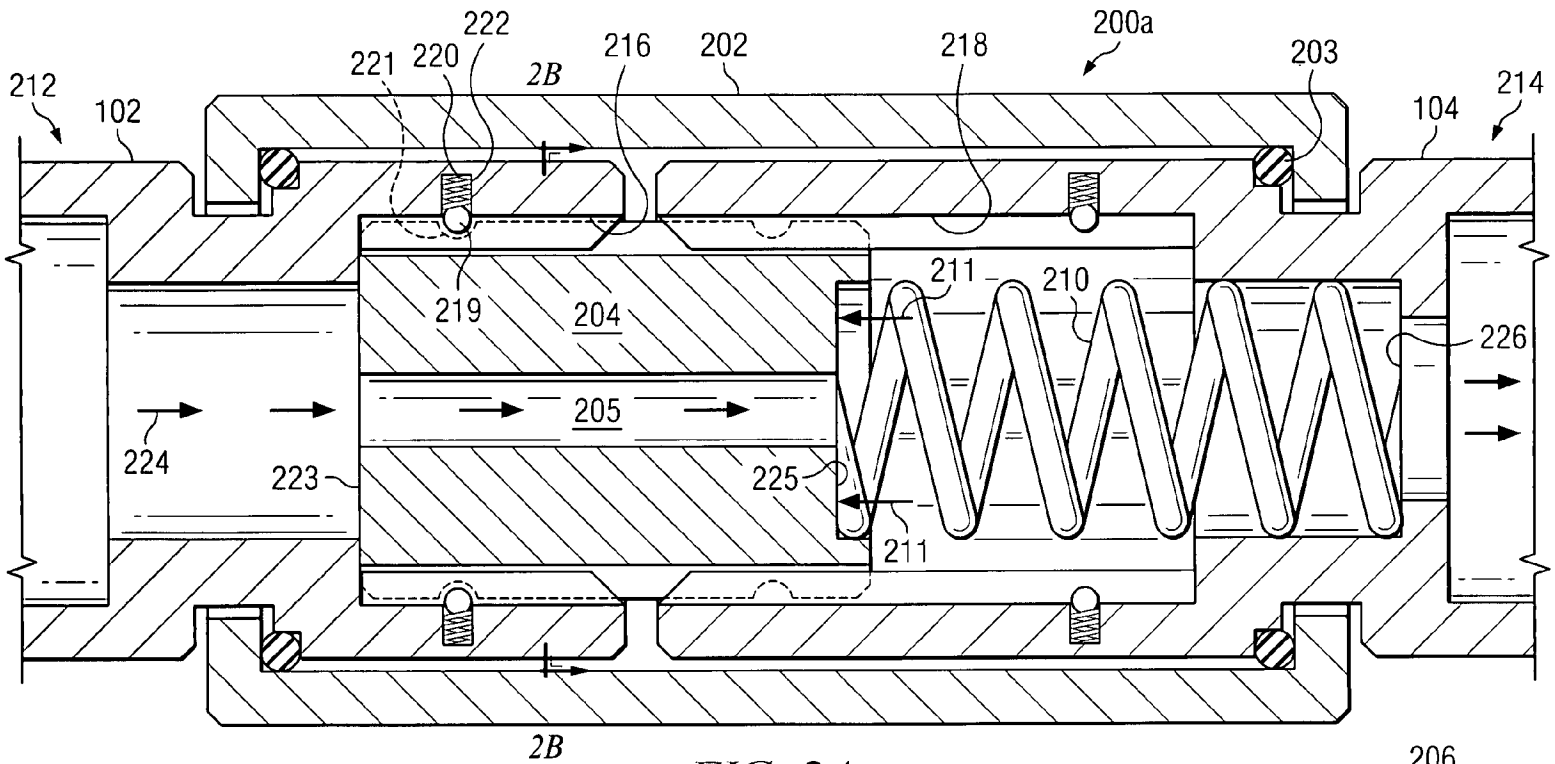
FIGS. 2A, 2B and 2C are cross-sectional views of a clutch assembly for use in the system of FIG. 1 according to one embodiment of the present invention.
Figure 2B:
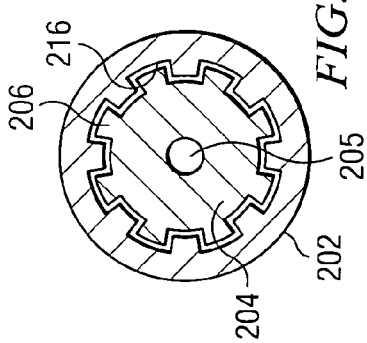
Figure 2C:
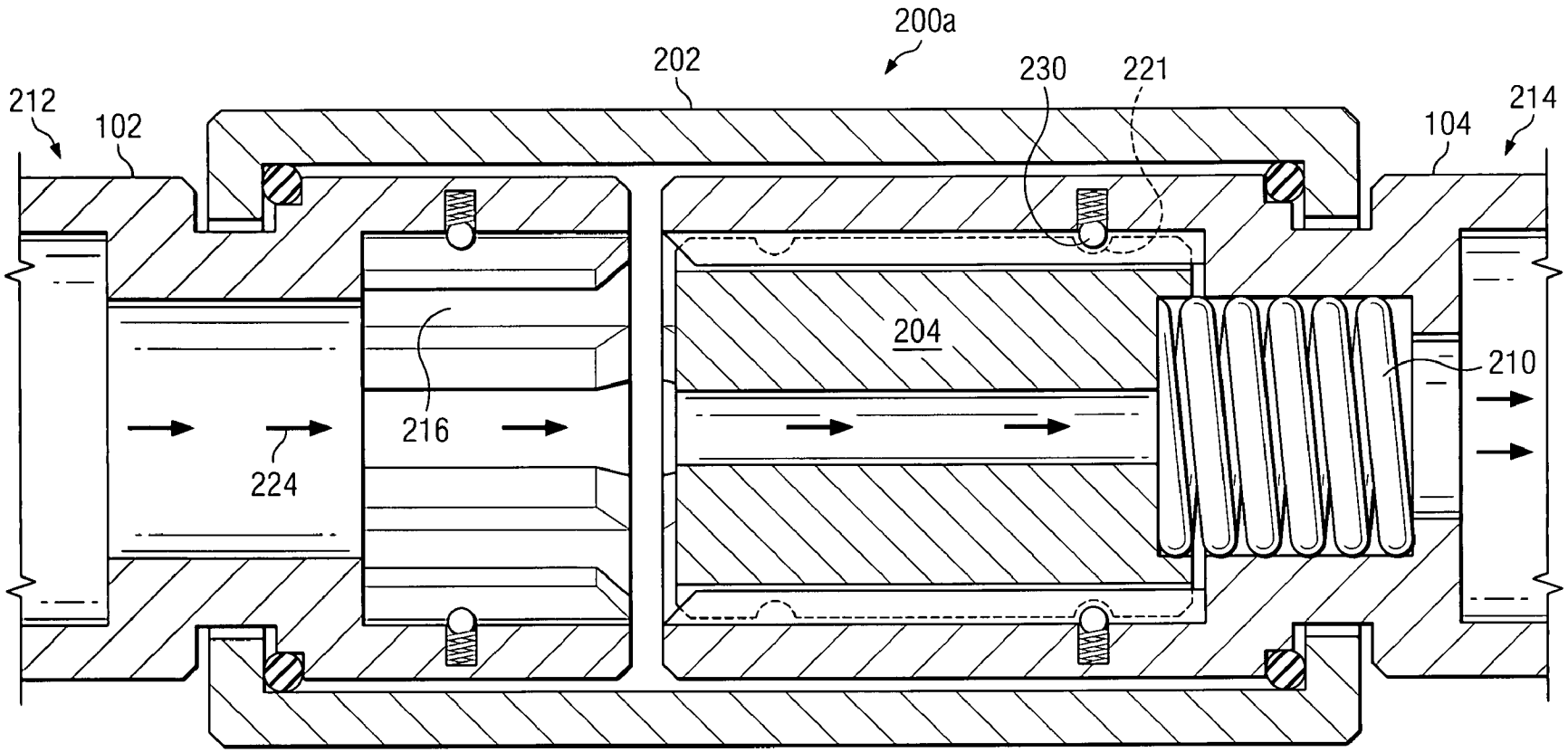

FIGS. 2A through 2C are cross-sectional views of a clutch assembly 200*a* according to one embodiment of the invention. In the illustrated embodiment, clutch assembly 200*a* includes a housing 202, a piston 204, and a biasing member 210.

Housing 202 is rotatably coupled to a lower end 212 of upper portion 102 and to an upper end 214 of lower portion 104 by any suitable method such as bearings 203, which may be any suitable bearings. Seals may also be utilized with bearings 203. Both lower end 212 and upper end 214 may be formed integral with its respective drill pipe segment of drill string 101 or may be separate components that are coupled to their respective drill pipe segment with suitable couplings or spacers (not illustrated).

Piston 204 is any suitably shaped element having a passageway 205 formed therein that includes a plurality of spline teeth 206 (FIG. 2B) that align with respective ones of a first set of channels 216 formed in the inner wall of lower end 212 and with respective ones of a second set of channels 218 formed in the inner wall of upper end 214. A longitudinal position of piston 204 determines whether or not clutch assembly 200*a* is engaged or disengaged. In FIG. 2A, piston 204 is in a position in which clutch 200*a* is engaged and thus translates rotation of upper portion 102 to lower portion 104. More specifically, spline teeth 206 of piston 205 engage respective channels 216 and 218 such that piston 204 connects lower end 212 to upper end 214. In particular embodiments, piston 204 may be isolated in an oil bath (not shown).

To aid in maintaining the position of piston 205 as show in FIG. 2A, a suitable locking mechanism 219 may be utilized. Locking mechanism 219, if utilized, engages a depression 221 formed on the outside of piston 204 as a result of a biasing member 220 disposed in a groove 222 formed in an inner wall of lower end 212. When an adequate force is applied to an end of piston 204, then locking member 219 retracts into groove 222 and compresses biasing member 220, which may be any suitable resilient member, such as a spring.

Passageway 205 allows fluid flowing through drill string 101 in a direction indicated by arrow 224 to flow through clutch assembly 200 (so that the drilling fluid may reach drill bit 108). Passageway 205 may be any suitable size and any suitable shape. This fluid flow exerts a force on a front end 223 of piston 204, which is counteracted by a spring force, as indicated by reference numeral 211, exerted on a back end 225 of piston 204 by biasing member 210. In order to translate piston 204 downstream, force 224 needs to be increased to overcome both the spring force 211 and the relatively small force exerted by locking mechanism 219 on piston 204. This is described in greater detail below in conjunction with FIG. 2C.

Biasing member 210 may be a spring or other suitable resilient member operable to exert a force on back end 225 of piston 204, as indicated by arrows 211. Biasing member 210 may rest on a shoulder 226 associated with upper end 214 and may rest on a ledge 228 formed in back end 225 of piston 204. The size and force exerted by biasing member 210 is determined by the desired flow rates for drilling wellbore 103. For example, in one embodiment, a flow rate of approximately one hundred fifty gallons per minute is utilized during a normal drilling operation. In an example embodiment, a flow of one hundred fifty gallons per minute applies a force 224 of approximately thirty pounds to front end 223 of piston 204. Biasing member 210 thus needs to be strong enough to resist this force in order to keep piston 204 in the position shown in FIG. 2A. In order to overcome force 211 exerted by biasing member 210 (when disengagement of upper portion 102 and lower portion 104 is desired), force 224 is increased by increasing the flow rate of the fluid. This is illustrated below in conjunction with FIG. 2C.

Referring to FIG. 2C, piston 204 is shown in a position in which clutch assembly 200*a* is disengaged. Piston 204 is disengaged from lower end 212 and is engaged only with upper end 214. As can be seen in FIG. 2C, biasing member 210 is compressed because force 224 has been increased. A locking mechanism 230, which may function similarly to locking mechanism 219 described above, has engaged depression 221 in the wall of piston 204 to aid in keeping piston 204 in that particular position. Locking mechanism 230 is an added protection for any fluctuations of the fluid flow through drill string 101 that would change the force 224.

Because of the positioning of piston 204, upper portion 102 of drill string 101 may be rotated without rotating lower portion 104 of drill string 101. The direction of wellbore 103 may then be changed from first direction 110 to second direction 112 (or other suitable direction), as indicated in FIG. 1. After drill bit 108 has started drilling in second direction 112, then both upper portion 102 and lower portion 104 may both be rotated again, if so desired. This means that clutch assembly 200*a* would have to be re-engaged. To accomplish this, the fluid flow through drill string 101 is reduced again to allow force 211 of biasing member 210 to translate piston 204 back to a position in which spline teeth 206 engage both channels 216 on lower end 212 and channels 218 on upper end 214, as illustrated in FIG. 2A.

Figure 3A:
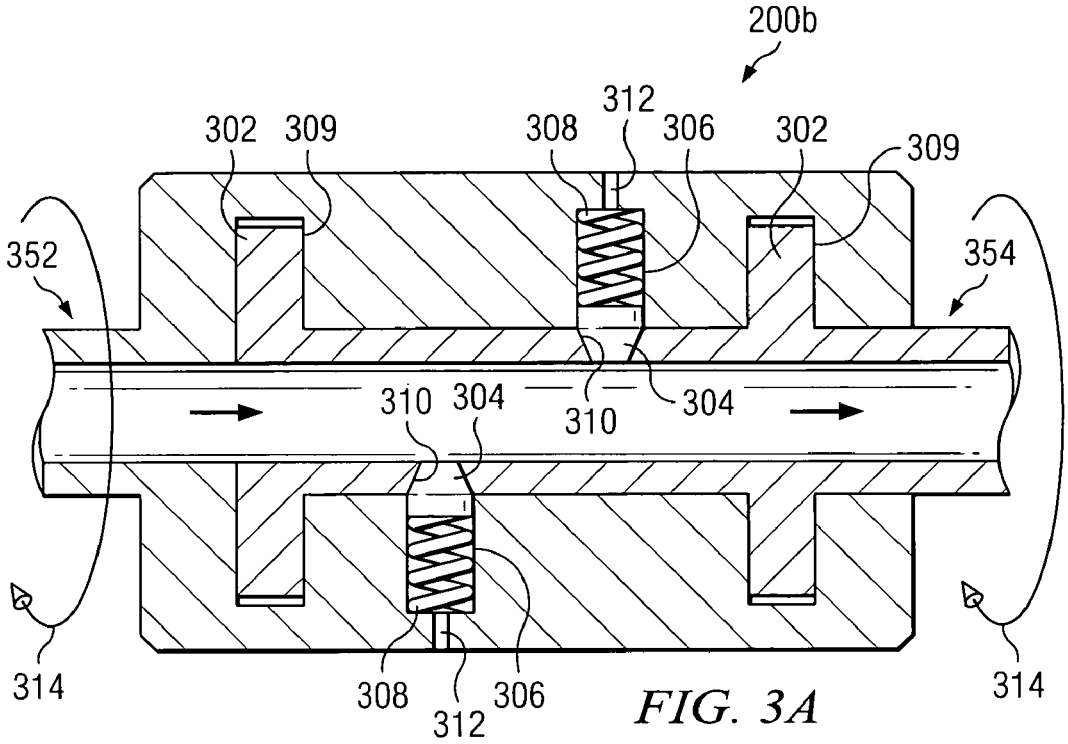
FIGS. 3A and 3B are cross-sectional views of a clutch assembly for use in the system of FIG. 1 according to another embodiment of the present invention.
Figure 3B:
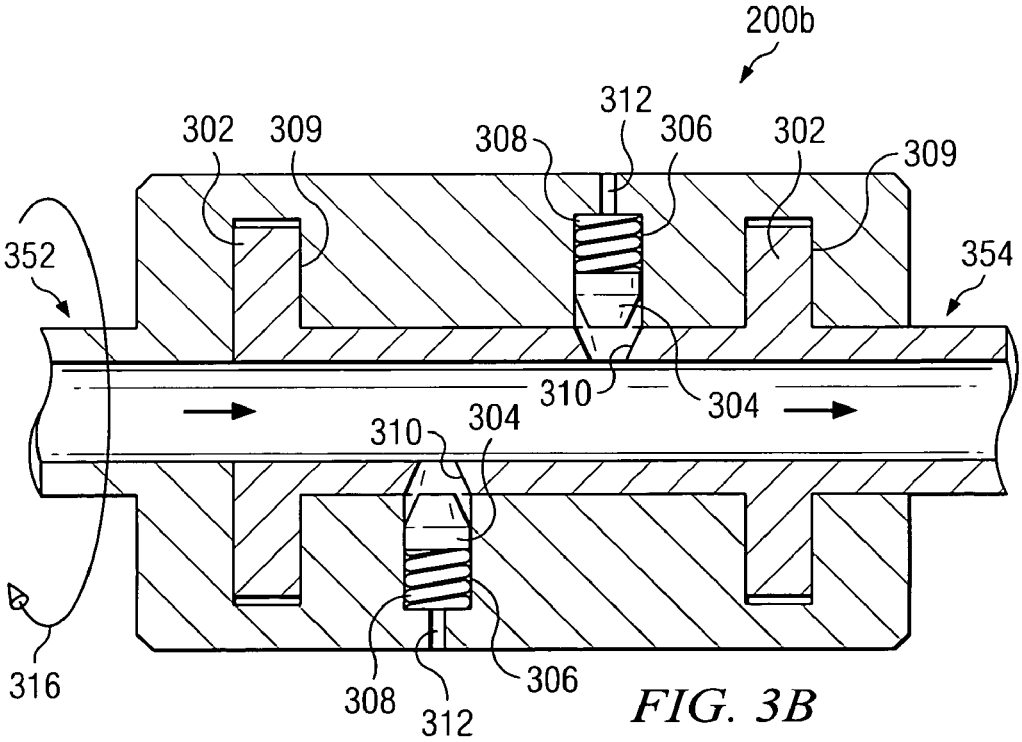

FIGS. 3A and 3B are cross-sectional views of a clutch assembly 200*b* in accordance with another embodiment of the present invention. In the illustrated embodiment, clutch assembly 200*b* includes a housing 300, one or more flanges 302, one or more pistons 304, and one or more biasing members 308 associated with respective pistons 304.

Housing 300 may be any suitably shaped housing that includes one or more channels 309 for accepting respective flanges 302. Housing 300 may be coupled to or formed integral with either a lower end 352 of upper portion 102 or an upper end 354 of lower portion 104, and flanges 302 may be coupled to or formed integral with either upper end 354 of lower portion 104 or lower end 352 of upper portion 102. In either event, flanges 302 are free to rotate with channels 309.

Housing 300 includes one or more chambers 306 that house respective pistons 304 and biasing members 308. Biasing members 308 exert an inward force on respective pistons 304 so that pistons 304 engage respective apertures 310 formed in a wall of upper end 214 of lower portion 104 (assuming flanges 309 are associated with upper end 214) when clutch assembly 200*b* is in an engaged position. In this manner, when upper portion 102 of drill string 101 rotates, then lower portion 104 of drill string 101 rotates. Flanges 302 fit within channels 309 in order to provide longitudinal stability to clutch assembly 200*b* so that the pistons 304 stay longitudinally aligned with apertures 310.

In one embodiment, pistons 304, which may have any suitable shape, translate into an out of apertures 310 depending upon the amount of fluid pressure within the drill string 101. Biasing members 308 exert a force on the back side of pistons 304 to push pistons 304 into apertures 310. In order to release pistons 304 from apertures 310, the force exerted on the face of pistons 304 need to overcome the force generated by biasing members 308. This is accomplished, in one embodiment, by increasing the flow rate of fluid through drill string 101. This increased flow rate increases the pressure within drill string 101 and results in a higher differential pressure between the face of each piston 304 and the back side of each piston 304. When the differential pressure reaches a certain value, pistons 304 translate back into chambers 306 and disengage clutch assembly 200*b* so that upper portion 102 of drill string 101 can rotate without rotating lower portion 104. To ensure the differential pressure acts on pistons 304, chambers 306 are coupled to the outside of housing 300 with respective vent ports 312.

Thus, as indicated in FIG. 3A when clutch assembly 200*b* is engaged, both upper portion 102 and lower portion 104 are rotating in the same direction, as indicated by arrows 314. When the flow of fluid through drill string 101 is increased, then a high differential pressure existing between the faces of pistons 304 and the back sides of pistons 304 causes pistons 304 to translate into chambers 306, thereby disengaging clutch 200*b*. Upper portion 102 may then be rotated, as referenced by reference numeral 316 in FIG. 3B, while lower portion 104 does not rotate.

Figure 4A:
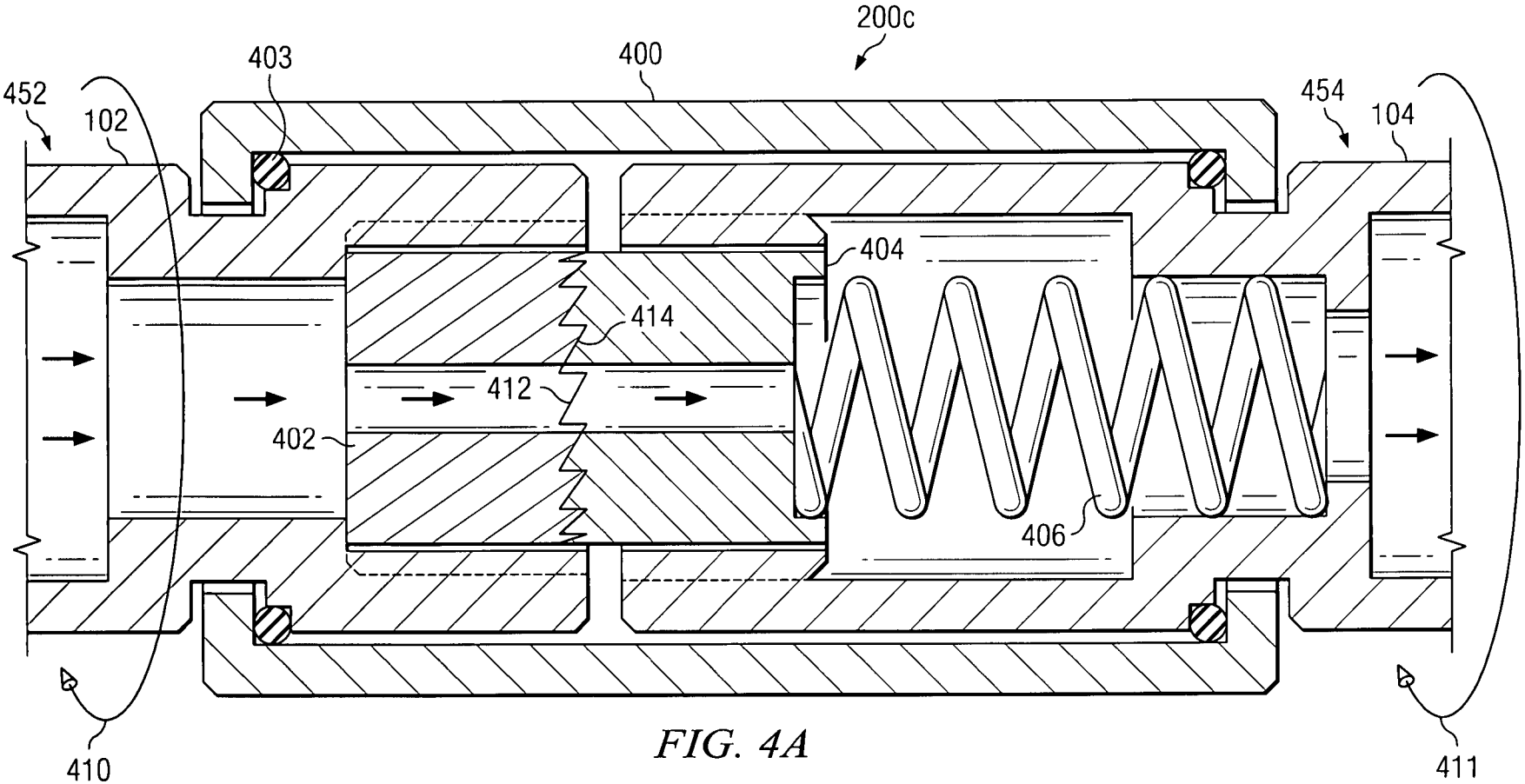
FIGS. 4A and 4B are cross-sectional views of a clutch assembly for use in the system of FIG. 1 according to another embodiment of the present invention.
Figure 4B:
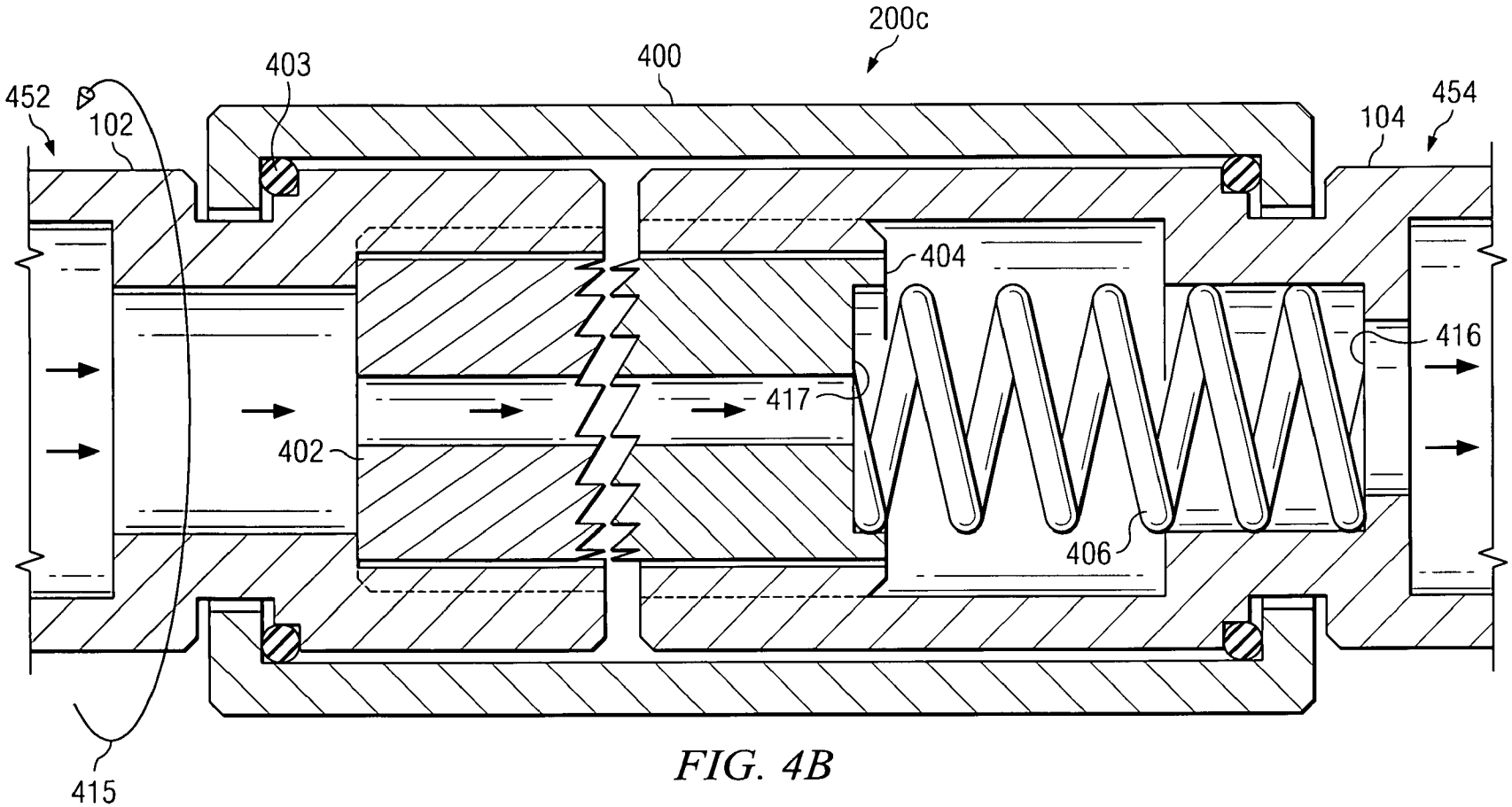

FIGS. 4A and 4B are cross-sectional views of a clutch assembly 200*c* in accordance with another embodiment of the present invention. In this embodiment, clutch assembly 200*c* functions like a ratcheting assembly and includes a housing 400, a ratchet element 402 associated with a lower end 452 of upper portion 102, a pawl 404 associated with an upper end 454 of lower portion 104, and a biasing member 406.

Housing 400 is rotatably coupled to both lower end 212 and upper end 214 by suitable bearings 403, which may be any suitable bearings. Seals may also be utilized with bearings 403. Housing 400 functions to provide stability for lower end 212 and upper end 214 so that the teeth associated with ratchet element 402 and pawl 404 properly align and function properly, as described below.

Ratchet element 402 and pawl 404 work in conjunction with one another to allow lower portion 104 of drill string 101 to be rotated by upper portion 102 in one direction only, as indicated by arrow 410. As such, ratchet element 402 includes a plurality of teeth 412 that align with a plurality of teeth 414 associated with pawl 404.

Because of the way teeth 412 and 414 are angled, when upper portion 102 rotates in the direction indicated by arrow 410, then lower portion 104 rotates in the same direction, as indicated by arrow 411. However, when it is desired to stop rotating lower section 104, then upper portion 102 is merely rotated in the opposite direction to that of arrow 410, as indicated in FIG. 4B by arrow 415. The teeth 412 associated with ratchet element 412 then exert forces on the angled surfaces of teeth 414 and essentially pushes pawl 404 away from ratchet element 402 and slightly compresses biasing member 406, as indicated in FIG. 4B, so that upper portion 102 may rotate freely while keeping lower portion 104 stationary.

Other suitable mechanisms other than biasing member 406 may be utilized to allow pawl 404 to translate within upper end 214 of lower portion 104. In an embodiment where biasing member 406 is a spring, then biasing member 406 may rest on a shoulder 416 of upper end 214 and rest on a ledge 417 associated with the back side of pawl 404.

Although embodiments of the invention and their advantages are described in detail, a person of ordinary skill in the art could make various alterations, additions, and omissions without departing from the spirit and scope of the present invention as defined by the appended claims.

The invention claimed is:

1. A system for directional drilling within a wellbore, comprising:

a drill string comprising an upper portion, a lower portion, a bent motor coupled to the lower portion, and a drill bit coupled to bent motor; and a clutch assembly disposed between the upper and lower portions, the clutch assembly operable to disengage the upper and lower portions of the drill string such that the upper portion may be rotated without rotating the lower portion.

2. The system of claim 1, wherein a length of the lower portion is at least 1000 feet.

3. The system of claim 1, wherein a weight of the lower portion is at least 10,000 pounds.

4. The system of claim 1, wherein the clutch assembly comprises:

a housing rotatably coupled to the upper portion and the lower portion;

a piston having a passageway formed therein, the piston comprising a plurality of spline teeth that align with respective ones of a first set of channels formed in an inner wall of the upper portion and with respective ones of a second set of channels formed in an inner wall of the lower portion; and a biasing member associated with the lower portion and exerting a longitudinal force on the piston in the direction of the upper portion;

and wherein the spline teeth of the piston are selectively engageable with the first set of channels to rotatably couple the upper portion with the lower portion.

5. The system of claim 4, wherein the piston is isolated in an oil bath.

6. The system of claim 4, further comprising a fluid pump operable to control an amount of a fluid pumped through the drill string so as to control the longitudinal position of the piston and the engagement of the spline teeth of the piston with the first set of channels.

7. The system of claim 1, wherein the clutch assembly comprises:

a housing coupled to the upper portion;

one or more flanges associated with an upper end of the lower portion, the flanges rotatably disposed within respective channels formed in the inside wall of the housing; and one or more pistons each laterally disposed within an associated chamber formed in a wall of the housing; a biasing member disposed within each chamber and exerting an inward force on the associated piston;

and wherein each piston is selectively engageable with an aperture formed in a wall of the lower portion to rotatably couple the upper portion with the lower portion.

8. The system of claim 7, wherein the housing is formed integral with the lower end of the upper portion.

9. The system of claim 7, further comprising a passageway coupling the chamber to an outside surface of the housing.

10. The system of claim 7, wherein the one or more pistons comprises a plurality of pistons existing at different longitudinal and radial positions with respect to the housing.

11. The system of claim 7, further comprising a fluid pump operable to control an amount of a fluid pumped through the drill string so as to control the lateral position of the one or more pistons.

12. A system for directional drilling within a wellbore, comprising: a drill string comprises an upper portion, a lower portion, a bent motor coupled to the lower portion, and a drill bit coupled to bent motor; and a ratchet assembly disposed between the upper and lower portions, the ratchet assembly operable to rotationally disengage the upper and lower portions of the drill string and allow the upper portion to rotate while the lower portion does not rotate.

13. The system of claim 12, wherein a length of the lower portion is at least 1000 feet.

14. The system of claim 12, wherein a weight of the lower portion is at least 10,000 pounds.

15. The system of claim 12, wherein the ratchet assembly comprises: a housing rotatably coupled to the upper portion and the lower portion; a first set of teeth associated with the upper portion; a piston having a second set of teeth associated with the lower portion; a biasing member associated with the lower portion and exerting a longitudinal force on the piston in the direction of the upper portion; and wherein the first and second set of teeth are selectively engageable to allow the lower portion to rotate when the upper portion rotates in a first rotational direction and to allow the upper portion to rotate in a second rotational direction opposite the first rotational direction without rotating the lower portion.

16. A method for directional drilling within a wellbore, comprising: flowing a fluid through a drill string disposed in a wellbore at a first velocity; rotating a drill bit within the wellbore; rotating an upper portion and a lower portion of the drill string in a first rotational direction; flowing the fluid through the drill string at a second velocity greater than the first velocity, thereby disengaging the upper and lower portions of the drill string such that the upper portion rotates without rotating the lower portion; and continuing to rotate the drill bit to alter the direction of the wellbore.

17. The method of claim 16, wherein the first velocity is approximately 150 gallons per minute.

18. The method of claim 16, wherein the second velocity is greater than approximately 150 gallons per minute.

19. The method of claim 16, wherein a length of the lower portion is at least 1000 feet.

20. The method of claim 16, wherein the weight of the lower portion is 10,000.

21. The method of claim 16, wherein disengaging the upper and lower portions of the drill string comprises translating a piston into the lower portion.

22. The method of claim 21, further comprising isolating the piston in an oil bath.

23. The method of claim 16, wherein disengaging the upper and lower portions of the drill string comprises translating a piston into a housing associated with the upper portion.

24. A method for directional drilling within a wellbore, comprising: rotating a drill bit within the wellbore; rotating an upper portion and a lower portion of the drill string in a first rotational direction; rotating the upper portion of the drill string in a second rotational direction opposite the first rotational direction, thereby rotationally disengaging the upper and lower portions of the drill string such that the upper portion rotates without rotating the lower portion; and continuing to rotate the drill bit to alter the direction of the wellbore.

25. The method of claim 24, wherein a length of the lower portion is at least 1000 feet.

26. The method of claim 24, wherein a weight of the lower portion is at least 10,000 pounds.

27. A system for directional drilling within a wellbore, comprising:

a drill string defining a fluid passageway, and comprising an upper portion, a lower portion, a bent motor coupled to the lower portion, and a drill bit coupled to the bent motor; and a clutch assembly disposed between the upper and lower portions, the clutch assembly operable to disengage the upper and lower portions of the drill string, in response to fluid flow through the passageway, such that the upper portion may be rotated without the lower portion.

* * * * *